United States Patent [19]

Ono et al.

[11] 4,167,289

[45] Sep. 11, 1979

[54] METHOD AND SYSTEM FOR CONTROLLING EARTH PRESSURE IN TUNNEL BORING OR SHIELD MACHINE

[75] Inventors: Kozo Ono; Masao Suda, both of Tsuchiura, Japan

[73] Assignee: Hitachi Construction Machinery Co., Ltd., Japan

[21] Appl. No.: 837,801

[22] Filed: Sep. 29, 1977

[51] Int. Cl.[2] ..... E21D 9/04

[52] U.S. Cl. ..... 299/1; 299/33; 405/141

[58] Field of Search ..... 299/1, 31, 33, 18; 61/85; 222/413; 405/136, 137, 138, 141, 144

[56] References Cited

U.S. PATENT DOCUMENTS

| | | | |
|---|---|---|---|
| 1,529,379 | 3/1925 | Thompson | 222/413 |
| 3,722,715 | 3/1973 | Young | 222/413 |
| 3,769,804 | 11/1973 | Matsushima | 61/85 |
| 3,822,809 | 7/1974 | Foucalt | 222/413 |
| 3,881,777 | 5/1975 | Altseimer | 299/33 |
| 3,961,825 | 6/1976 | Lovar | 299/33 |
| 4,040,666 | 8/1977 | Uchida | 299/1 |
| 4,068,486 | 1/1978 | Uchida | 61/85 |

*Primary Examiner*—William Pate, III
*Attorney, Agent, or Firm*—Craig and Antonelli

[57] ABSTRACT

In a tunnel boring or shield machine, a method and system for controlling the earth pressure, in which the earth pressure in the chamber of the shield machine body is detected and the detected earth pressure is compared with a reference value to thereby produce a chamber earth pressure deviation signal. In response to the chamber earth pressure deviation signal, means for controlling the amount of conveying earth accumulated in the chamber to the exterior of the machine body and/or means for advancing the shield machine body into the working face are controlled so as to maintain the earth pressure in the chamber within a predetermined range so that the breakdown of the exposed face or earth stratum as well as the rising of the ground are prevented from occurring.

In another method and system, the earth pressure at the working face is detected and the detected value is compared with a reference value to produce a signal representing the earth pressure deviation at the working face.

26 Claims, 12 Drawing Figures

METHOD AND SYSTEM FOR CONTROLLING EARTH PRESSURE IN TUNNEL BORING OR SHIELD MACHINE

LIST OF PRIOR ART REFERENCES (37 CFR 1.56 (a))

The following reference is cited to show the state of the art:

Japanese Patent Application Kokai (Laid-Open) No. 51-732 (1976) "Method of Boring Tunnel by Shield Process".

This invention relates to methods and systems for controlling the earth pressure during boring tunnels with shield type tunnel boring machines, and more particularly to methods and systems for carrying out earth pressure control suitable for boring a tunnel in soft ground which is so soft as to easily breakdown and from which water exudes.

Figure 1B:
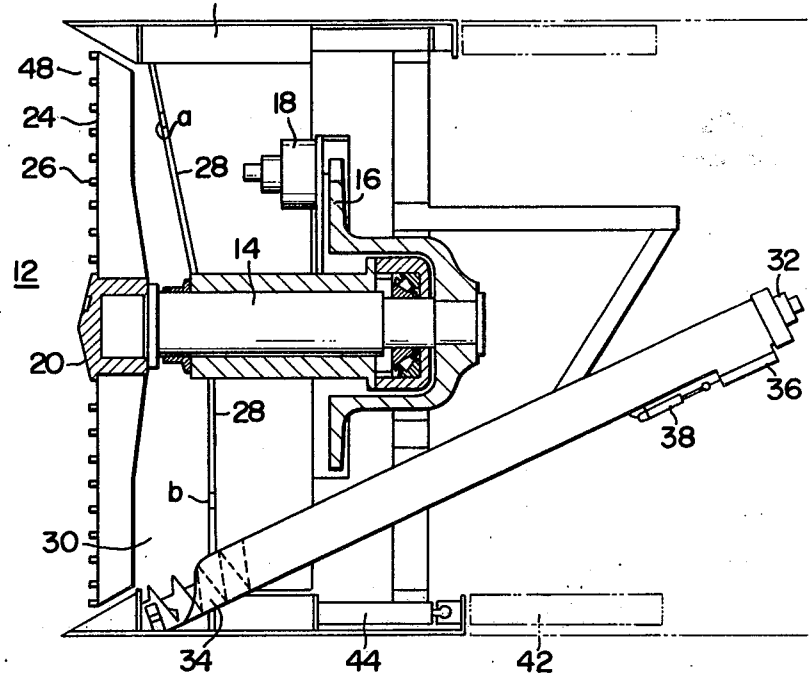
FIG. 1B is a schematic axial sectional view of the machine shown in FIG. 1A.

The necessity for boring tunnels in soft ground is increasing more and more for principal purposes of providing sewer systems in cities. Effective techniques for achieving these purposes are broadly classified into a so-called earth-pressure shield technique and a so-called slurry mole shield technique. These techniques will be briefly described with reference to the drawing. In the drawing, like reference numerals are used throughout to designate like parts.

Figure 1A:
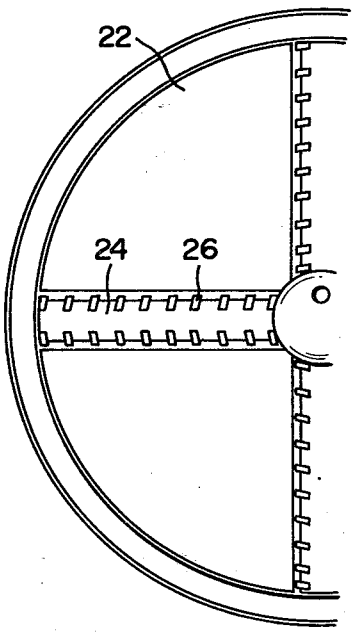
FIG. 1A is a schematic front elevational view of the left-hand portion only of a rotary cutter type tunnel boring machine to which the present invention is applied.

FIGS. 1A and 1B show a rotary cutter type tunnel boring machine or shield machine generally used for boring a tunnel according to the earth-pressure shield technique. FIG. 1A is a schematic front elevational view of the shield machine with its right-hand portions omitted, and FIG. 1B is a schematic axial sectional view of the machine shown in FIG. 1A.

Referring to FIGS. 1A and 1B, a cutter head 12 is disposed at the front end of the shield machine body 10 which is cylindrical in shape. The cutter head 12 is driven for rotation by a hydraulic motor 18 through a rotary shaft 14 and a transmission mechanism 16. The cutter head 12 is composed of a supporting member 20, a segmented face plate 22 securely fixed to the supporting member 20 for preventing breakdown of the exposed face, a plurality of rotary vanes 24 extending radially outwardly from the supporting member 20, and a multiplicity of cutter teeth 26 mounted in radially aligned relation on the front face of the rotary vanes 24. A bulkhead 28 is mounted in the machine frame immediately behind the cutter head 12, and a chamber 30 is defined between the cutter head 12 and the bulkhead 28. A rotary screw conveyor 34 is driven by a hydraulic motor 32 and has its front open end inserted into the chamber 30. A slide gate 36 is provided for discharging earth conveyed by the screw conveyor 34 and is opened and closed by means of a hydraulic jack 38. A hood 40 is disposed along the circumference of the machine frame of the shield machine body 10 to be forced or driven toward and into a working face 48 by means of shield jacks 44 each of which is supported at one end by an earth-retaining concrete segment 42.

Figure 2B:
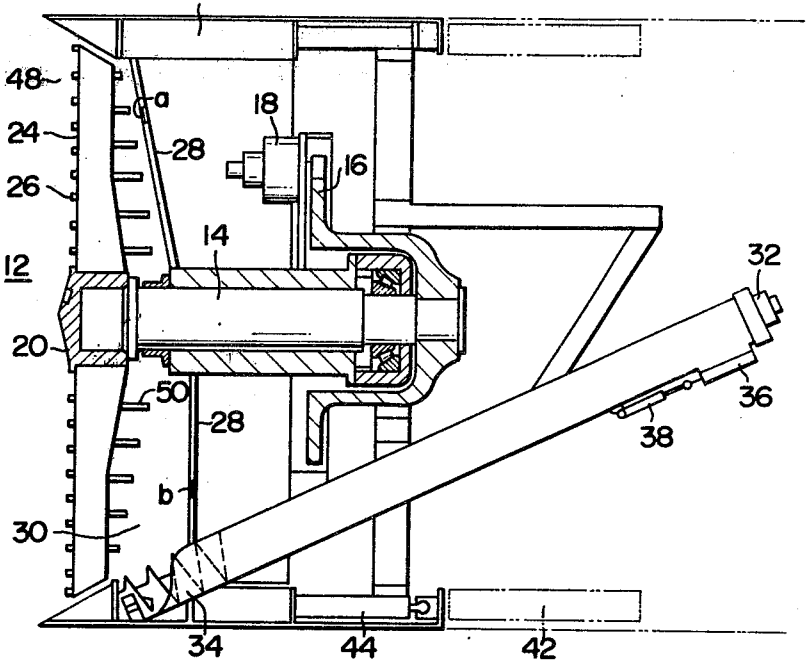
FIG. 2B is a schematic axial sectional view of the machine shown in FIG. 2A.
Figure 2A:
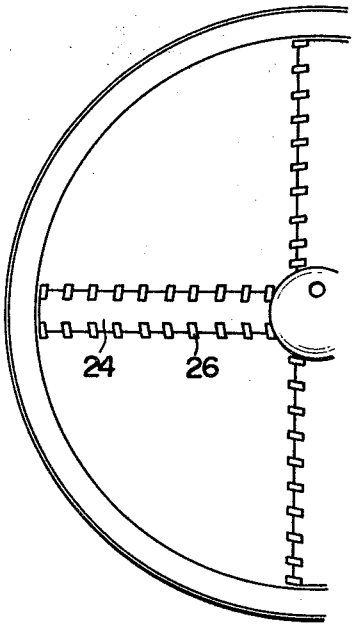
FIG. 2A is a schematic front elevational view of the left-hand portion only of another rotary cutter type tunnel boring machine to which the present invention is also applied.

In boring a tunnel with the shield machine of the type having the aforementioned construction, the cutter head 12 is rotated by the hydraulic motor 18 to remove earth or muck from the working face 48 with its cutter teeth 26. The removed earth or muck is accumulated at the working face 48 and in the chamber 30 and then conveyed from the chamber 30 into the shield machine body 10 by the screw conveyor 34. The earth or muck is then discharged from the slide gate 36 to be transported to the exterior by a transporting means such as a truck. With the boring operation at the working face 48, the shield machine body 10 is advanced as the hood 40 is driven into the working face 48 by the force of the shield jacks 44. The intuition and experience of the operator is generally resorted to for preventing breakdown of the exposed face or earth stratum and rising of the ground. The operator prevents such an objectionable situation by controlling the pressure of hydraulic fluid supplied to the shield jacks 44 driving the hood assembly 40 or the pressure of hydraulic fluid supplied to the hydraulic motor 18 driving the cutter head 12, or he detects an abnormal state of the exposed face by roughly comparing the amount of removed earth with the amount of conveyed earth. The face plate 22 provided in the cutter head 12 acts also to mechanically prevent breakdown of the exposed face. Further, in a tunnel boring machine as disclosed in Japanese Laid-Open Patent Application No. 51-732 (1976) and as shown in FIGS. 2A and 2B, agitating vanes 50 are provided in the chamber 30 to impart an agitating action to the earth accumulating in the chamber 30. In the form shown in FIGS. 2A and 2B, a suitable soil nature adjusting agent such as an aqueous solution soil bentonite is injected into the chamber 30 to be mixed with the excavated earth in the chamber 30 thereby turning the excavated earth into mud of high viscosity so that the earth pressure of such mud can be utilized for preventing breakdown of the exposed face. In the shield machine shown in FIGS. 2A and 2B, the face plate 22 in FIGS. 1A and 1B is eliminated. However, excellent intuition as well as rich experience is required for the operator since he manipulates the shield machine at the location where he cannot utterly see the state of the working face.

Figure 3B:
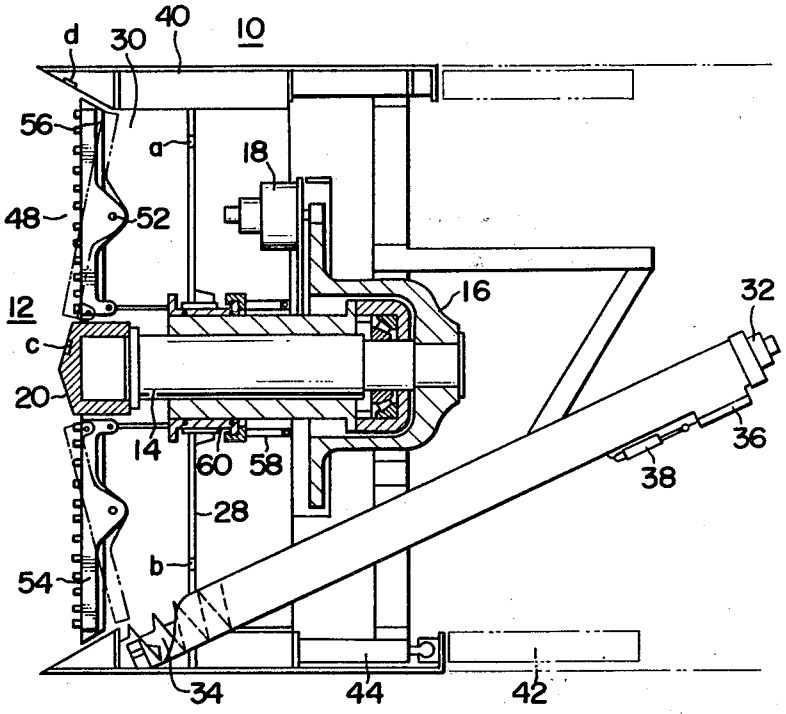
FIG. 3B is a schematic axial sectional view of the machine shown in FIG. 3A.
Figure 3A:
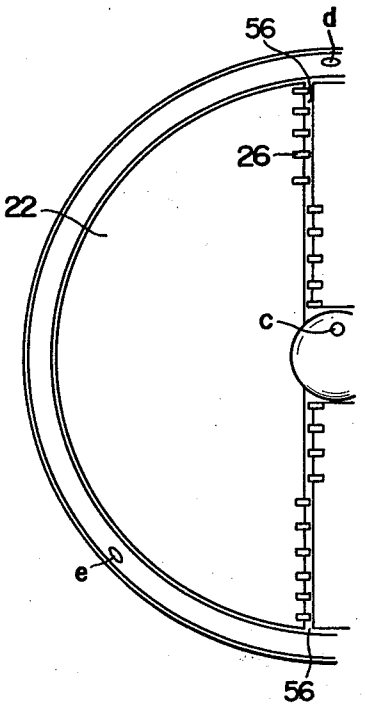
FIG. 3A is a schematic front elevational view of the left-hand portion only of still another rotary cutter type tunnel boring machine to which the present invention is also applied.

FIGS. 3A and 3B show still another shield machine. In the shield machine of the type shown in FIGS. 3A and 3B, its cutter head 12 is generally composed of a supporting member 20, a disc-shaped face plate 22 securely fixed to the supporting member 20 opposite a working face 48 for preventing breakdown of the exposed face, and a plurality of cutter teeth 26 mounted on the front wall of the face plate 22. As shown in FIG. 3B, the shield machine is provided with slit adjusting cutter members 54 which are rockable around respective pivots 52 relative to the face plate 22, and a plurality of cutter teeth 26 are also mounted on the front wall of each of these slit adjusting cutter members 54. The area of each of slits 56 defined between the slit adjusting cutting members 54 and the face plate 22 is adjusted to control the amount of earth removed from the working face 48 and entering a chamber 30 described below. In the form shown in FIGS. 3A and 3B, the actuating force of hydraulic jacks 58 fixed at their base to the machine frame of the shield machine body 10 is transmitted through a transmission mechanism 60 to one end of the slit adjusting cutter members 54 to cause the rocking movement of the slit adjusting cutter members 54 relative to the face plate 22.

A bulkhead 28 is mounted in the machine frame immediately behind the face plate 22, and a chamber 30 is defined between the face plate 22 and the bulkhead 28. A rotary screw conveyor 34 is driven by a hydraulic motor 32 and has its front open end inserted into the chamber 30. The operation of the screw conveyor 34 shown in FIG. 3B is entirely similar to that described with reference to FIGS. 1A and 1B.

In boring a tunnel with the shield machine of the type having the above construction, the cutter head 12 is rotated by the hydraulic motor 18 to remove earth from the working face 48 with its cutter teeth 26. The removed earth or muck enters the chamber 30 through the slits 56 defined between the face plate 22 and the slit adjusting cutter members 54 and is then conveyed from the chamber 30 into the shield machine body 10 by the screw conveyor 34. The earth or muck is then discharged from a slide gate 36 to be transported to the exterior by a transporting means such as a truck. With the boring operation at the working face 48, the shield machine body 10 is advanced as a hood 40 is driven into the working face 48 by the force of shield jacks 44. Breakdown of the exposed face is also prevented by the face plate 22 in the cutter head 12. However, the intuition and experience of the operator is resorted to for the most part for preventing breakdown of the exposed face and rising of the ground. The operator prevents such an objectionable situation by controlling the pressure of hydraulic fluid supplied to the shield jacks 44 driving the hood 40 or the pressure of hydraulic fluid supplied to the hydraulic motor 18 driving the cutter head 12, or by causing the rocking movement of the cutter members 54 relative to the face plate 22, thereby adjusting the amount of earth or muck removed from the working face 48 and entering the chamber 30 for regulating the pressure imparted to the exposed face. Also, the operator detects an abnormal state of the exposed face by roughly comparing the amount of removed earth with the amount of conveyed earth. Breakdown of the exposed face and rising of the ground can be prevented in the manner above described. However, as pointed out hereinbefore, excellent intuition and rich experience are required for the operator since he manipulates the shield machine at the location where he cannot utterly see the state of the working face.

The principle of the so-called slurry mole shield technique will next be described. According to this technique, slurry is supplied to the working face 48 and chamber 30 in FIGS. 1A to 3B by a slurry feed pipe from a slurry disposal plant or the like disposed on the ground to fill the working space with slurry, and the pressure of slurry is maintained within a predetermined range to prevent breakdown of the exposed face and exudation of slurry from the exposed face. However, essentially, resorting to the slurry pressure alone is not the fully effective means for the desired prevention of breakdown of the exposed face, and the face plate 22 in the cutter head 12 is also utilized for preventing breakdown of the exposed face. While this slurry mole shield technique is effective in boring tunnel in soft ground, it requires various automatic control units including an automatic slurry pressure control unit, in addition to slurry disposal plant equipment including piping, pumps and a settling tank for supplying slurry into and discharging slurry from the shield machine. Thus, this technique is quite expensive considering the costs of the automatic control units and slurry disposal plant equipment occupying a wide ground space.

It is therefore a primary object of the present invention to provide a method and system for controlling the earth pressure during boring a tunnel with a shield machine, which obviate the defects of the prior art earth-pressure shield technique and slurry mole shield technique, and which can reliably and easily prevent breakdown of the exposed face and rising of the ground without requiring costs higher than those required for the prior art slurry mole shield technique.

Another object of the present invention is to provide an earth pressure controlling method and system in which the pressure of earth filling the chamber of the shield machine is controlled to be maintained between a lower limit which does not give rise to breakdown of the exposed face and an upper limit which does not give rise to rising of the ground, since such an earth pressure, in the case of soft ground, will have almost uniform distribution like that of fluid.

Still another object of the present invention is to provide an earth pressure controlling method and system in which the pressure of earth or muck in muddy condition removed from the exposed face and filling the area of the working face is controlled to be maintained between a lower limit which does not give rise to breakdown of the exposed face and an upper limit which does not give rise to rising of the ground, since such an earth pressure, in the case of soft ground, will have almost uniform distribution like that of fluid.

Yet another object of the present invention is to provide an earth pressure controlling method and system which can automatically control the amount of earth conveyed by a conveying means such as a screw conveyor so as to maintain the earth pressure in the chamber of the shield machine within a predetermined range, which can automatically immediately stop the operation of the screw conveyor in the event of an abnormal situation which gives rise to unusual or dangerous flow-out of an excessive amount of earth from the working face into the shield machine, and which can thus ensure the safety of tunnel boring operation while permitting easier manipulation of the shield machine.

A further object of the present invention is to provide an earth pressure controlling method and system in which a deviation signal representing deviation of earth pressure detected in the chamber of the shield machine and a deviation signal representing deviation of earth amount obtained by detecting the advancing speed of the shield machine body and the operating speed of the screw conveyor are applied to a control deviation computing circuit, and the output of this computing circuit is used to maintain the earth pressure in the chamber of the shield machine within a predetermined proper range for minimizing adverse effects of disturbance on the control system.

Another object of the present invention is to provide an earth pressure controlling method and system in which the opening of the slit between the face plate and the cutter members is made adjustable and automatically controlled so as to maintain the earth pressure at the working face within a predetermined proper range, which can automatically completely close the above slit in the event of an abnormal situation which gives rise to unusual or dangerous flow-out of an excessive amount of earth from the working face into the shield machine thereby mechanically preventing breakdown of the exposed face, and which can thus ensure the safety of tunnel boring operation while permitting easier manipulation of the shield machine.

An embodiment of the present invention will now be described in detail with reference to its application to the shield machines shown in FIGS. 1A, 1B, 2A and 2B.

Figure 4:
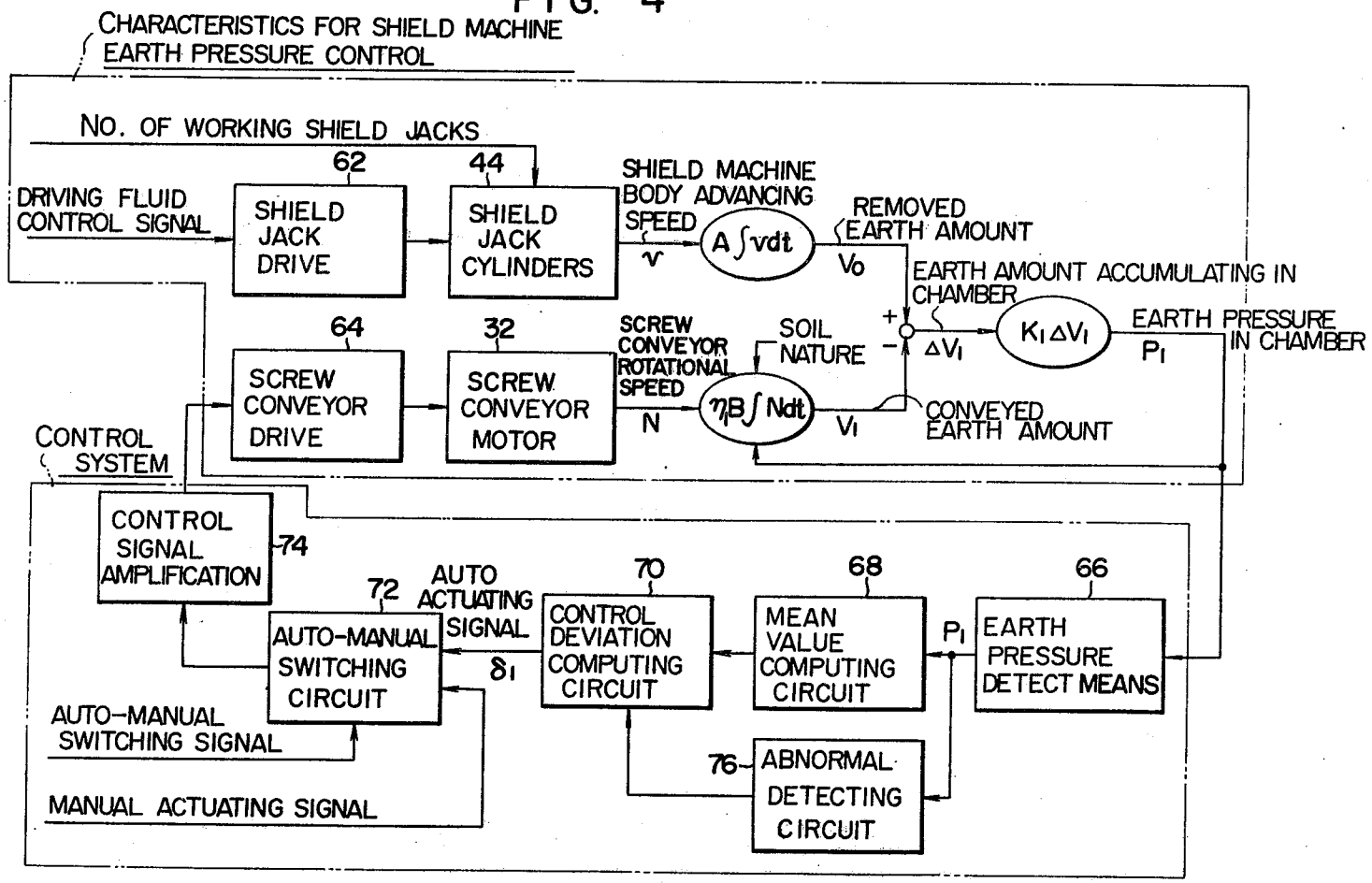
FIG. 4 is a control system diagram according to an embodiment of the present invention.

FIG. 4 shows various characteristics considered in the present invention for the control of the earth pressure in the shield machine, and shows also the earth pressure control system according to the present invention. Numerical expressions of these characteristics will be discussed at first so that the concept of earth pressure control according to the present invention can be understood.

A signal for controlling the flow rate of pressure fluid supplied to the shield jacks 44 is applied externally as, for example, by manual operation by the operator. This control signal determines the output of a shield jack drive section 62 in FIG. 4. This output is used, for example, to control the flow rate of pressure fluid discharged from the hydraulic pump (not shown) for the shield jacks 44 which are connected in parallel to the hydraulic pump. The number n of working shield jacks 44 and the moving speed of the shield jack cylinders are also externally determined. Consequently, the advancing or boring speed v of the shield machine body 10 is determined. Thus, the amount $V_o$ of earth removed by advancing the shield machine is given by $$V_o = A \int v \, dt \tag{1}$$

where A is the sectional area of the shield machine body 10. It is noted that the amount of earth removed by the shield machine is equal to the advanced volume of the machine. An output corresponding to an input signal appears from a screw conveyor drive section 64 in FIG. 4. Such an output is applied to the hydraulic motor 32 which drives the screw conveyor 34. Consequently, the rotating speed N of the screw conveyor 34 is determined. Thus, the amount $V_1$ of earth conveyed by the screw conveyor 34 is given by $$V_1 = \eta_1 B \int N \, dt \tag{2}$$

where $\eta_1$ is a coefficient varying depending on the nature of soil, and B is a constant determined by the dimensions of the screw conveyor 34.

When, now, no face plate is provided as in FIGS. 2A and 2B, or when the gap between the face plate 22 and the rotary vanes 24 is sufficiently large to permit admission of substantially all the removed earth into the chamber 30 although the face plate 22 is provided as in FIGS. 1A and 1B, the amount $\Delta V_1$ of earth accumulating in the chamber 30 is given by $$\Delta V_1 = V_0 - V_1 \tag{3}$$

Suppose that the equivalent modulus of volumetric elasticity of earth in the chamber 30 is $K_1$ (which is determined by the factors including the nature of soil and the rigidity of the exposed face), then the earth pressure $P_1$ in the chamber 30 is given by $$P_1 = K_1 \Delta V_1 \tag{4}$$

The structure of the control system will now be described which controls the earth pressure $P_1$ in the chamber 30 on the basis of the characteristics obtained as the result of the above analysis.

The actual earth pressure cannot be computed from the formula obtained by the analysis because such factors as $\eta_1$ and $K_1$ are both very difficult to be preestimated. In the present invention, suitable earth pressure detecting means 66 such as earth pressure meters are mounted on the bulkhead 28 at a plurality of locations such as those indicated by the symbols a and b in FIGS. 1B and 2B for detecting the earth pressures $P_1$ at such portions of the chamber 30. These detected values are then averaged so as to average the noise or peak values, or suitable weights are applied to the outputs of the earth pressure meters 66 depending on their locations so as to average the output values. The mean earth pressure is computed by a mean value computing circuit 68. The output of the mean value computing circuit 68 representing the mean earth pressure is then applied to a control deviation computing circuit 70 which computes a most suitable control deviation on the basis of a lower limit of earth pressure required for preventing breakdown of the exposed face and an upper limit of earth pressure required for preventing rising of the ground. This earth pressure deviation signal is applied from the control deviation computing circuit 70 to the screw conveyor drive section 64 through an automatic-manual switching circuit 72 and a control signal amplifying section 74. The control system is connected to the screw conveyor drive section 64 so that an increase in the earth pressure $P_1$ in the chamber 30 causes a corresponding increase in the rotating speed N of the hydraulic motor 32 driving the screw conveyor 34. Thus, a control loop is completed which includes sequential steps of detection of the earth pressure in the chamber 30 → generation ot the control signal → control of the operation speed of the screw conveyor 34 or shield jacks 44 → correction of the earth pressure in the chamber 30.

An abnormal state detecting circuit 76 is connected between the earth pressure detecting means 66 and the control deviation computing circuit 70. This abnormal state detecting circuit 76 detects the output of the earth pressure meter 66 disposed at the location (such as, the location a in FIGS. 1B and 2B) capable of immediately detecting breakdown of the working face 48, among the plural earth pressure meters 66, and generates a signal instructing cessation of the operation of the screw conveyor 34 as soon as the detected values attains zero or an allowable minimum. The circuit 76 may also generate a signal for closing the slide gate 36 in FIGS. 1B and 2B, or it may generate an alarm signal indicative of an abnormal condition of earth pressure meters by detecting inconsistency between the output values of the earth pressure meters 66. The automatic-manual switching circuit 72 is provided to deal with a soil condition which cannot be covered by the above-mentioned automatic control system alone or to prepare for possible unexpected failure of the automatic control elements. This circuit 72 acts to switch over between the automatic operation and the manual operation in response to a switching signal generated by the operator. It will thus be seen that, by the use of the control system shown in FIG. 4, tunnelling work can be safely carried out while maintaining the earth pressure $P_1$ in the chamber 30 at an appropriate value which does not give rise to breakdown of the exposed face and rising of the ground. Further, the shield machine can be operated very easily and with improved reliability since the amount of earth conveyed by the screw conveyor 34 can be automatically controlled.

The control system can be easily designed to have a control capacity which covers variations in the factors of disturbance, for example, the coefficient $\eta_1$ and modulus $K_1$ determined depending on the nature of soil. It is also possible to adjust $\eta_1$ and $K_1$ to within a certain selected range so as to minimize the adverse effects. This may be done by injecting a conventional soil nature adjusting agent such as an aqueous solution of bentonite into the chamber 30.

The values detected by the earth pressure meters 66 may vary over a very wide range, such that a delay time corresponding to the period of a large variation component may result even with the averaging of the detected earth pressure values by the mean value computing circuit 68. (For example, when the agitating vanes 50 are provided on the cutter head 12 as shown in FIG. 2B, the earth pressure in the chamber 30 will vary periodically with the rotation of the agitating vanes 50, since the rotating speed of the cutter head 12 is very low, for example, generally 2 to 3 r.p.m.) This delay will not impose any substantial effect on the operation of the control system in the case of ordinary soil. When, however, the equivalent modulus of volumetric elasticity $K_1$ is large (as, for example, in the case of a dense sand layer of small void ratio), a slight variation in the amount $\Delta V_1$ of earth accumulating in the chamber 30 will cause a large variation in the earth pressure, giving rise to such adverse effects as instability of the operation of the control system and impossibility of the desired control. In such a case, it is preferable to control the amount $\Delta V_1$ of earth accumulating in the chamber 30 to be constant rather than controlling the earth pressure itself in the chamber 30 as in the embodiment described with reference to FIG. 4. Practically, it is ideal to design the control system so that the earth pressure control and the earth amount control can be carried out in parallel or selectively depending on the soil.

Figure 5:
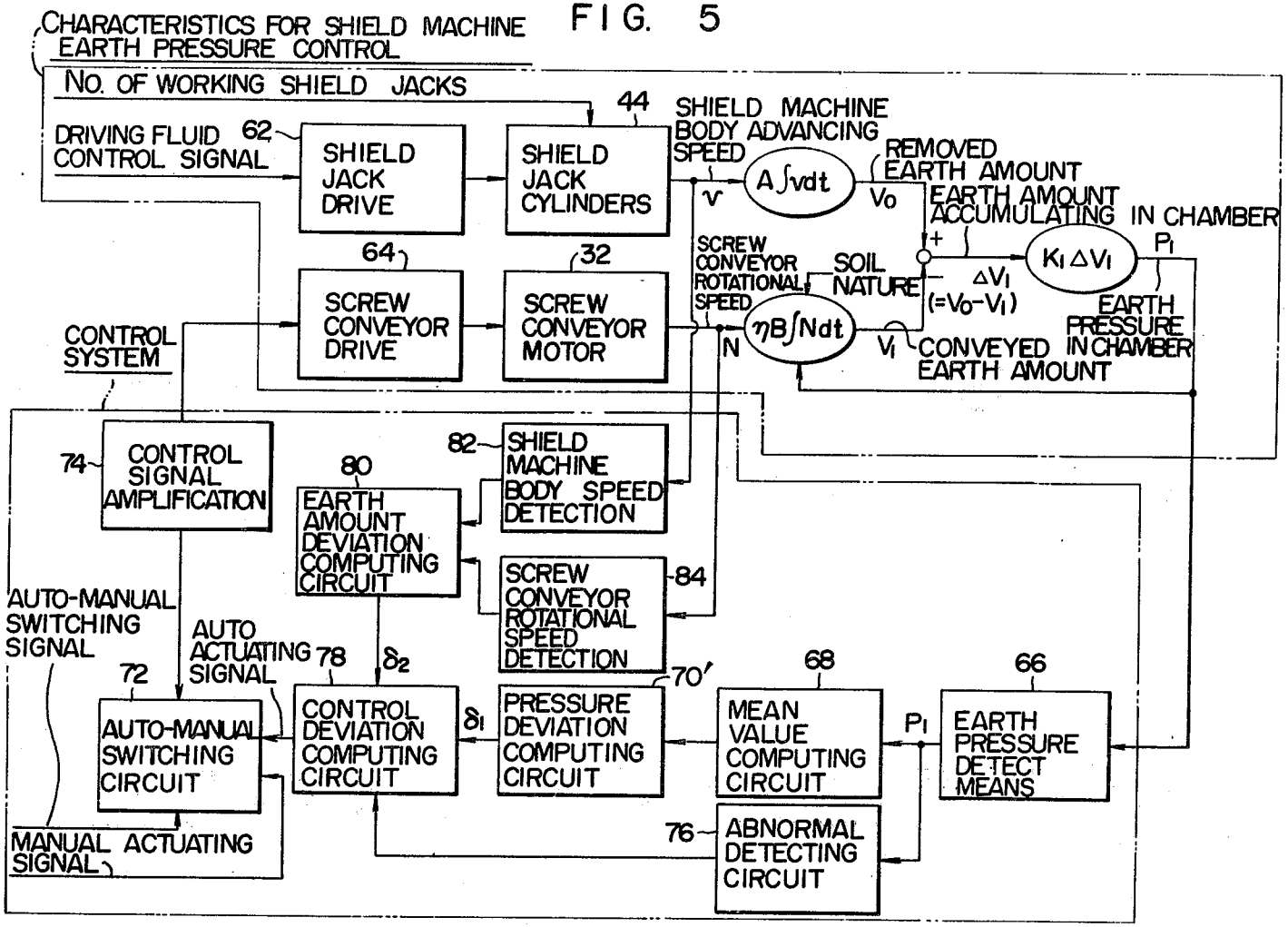
FIG. 5 is a control system diagram according to another embodiment of the present invention.

FIG. 5 shows another embodiment of the present invention in which the earth amount control is added to the embodiment shown in FIG. 4. In FIG. 5, the same or like reference numerals are used to denote the same or like blocks appearing in FIG. 4.

Referring to FIG. 5, the earth pressures $P_1$ in the chamber 30 detected by the earth pressure detecting means 66 are averaged by the mean value computing circuit 68, and the output representing the mean earth pressure is applied to a pressure deviation computing circuit 70'. This pressure deviation computing circuit 70' corresponds to the control deviation computing circuit 70 in the embodiment of FIG. 4 and compares the detected earth pressure value with a critical earth pressure value which does not give rise to breakdown of the exposed face and rising of the ground. The output representing the earth pressure deviation $\delta_1$ is applied to a control deviation computing circuit 78. An earth amount deviation computing circuit 80 compares the amount of earth conveyed by the screw conveyor 34 with the amount of removed earth computed by the advancing or boring speed of the shield machine body 10 to compute the rate of variation in the amount of earth (which is referred to hereinafter as an earth amount deviation $\delta_2$). In FIG. 5, a shield machine body speed detecting section 82 detects the boring speed v of the shield machine body 10, and a screw conveyor rotating speed detecting section 84 detects the rotating speed N of the screw conveyor 34. The outputs of these circuits 82 and 84 representing v and N respectively are applied to the circuit 80 which computes the earth amount deviation $\delta_2$ as follows:

$$\delta_2 = Av - \eta_{1m}BN \tag{5}$$

where A is the sectional area of the shield machine body 10, B is a constant determined by the dimensions of the screw conveyor 34, and $\eta_{1m}$ is a typical mean value of the earth conveying efficiency $\eta_1$ of the screw conveyor 34. The output representing the earth amount deviation $\delta_2$ is applied from the circuit 80 to the control deviation computing circuit 78. In response to the application of the inputs representing the earth pressure deviation $\delta_1$ and earth amount deviation $\delta_2$, the control deviation computing circuit 78 applies its output to the screw conveyor drive section 64 through the automatic-manual switching circuit 72 and control signal amplifying section 74 so as to maintain constant the earth pressure $P_1$ in the chamber 30.

Figure 6A:
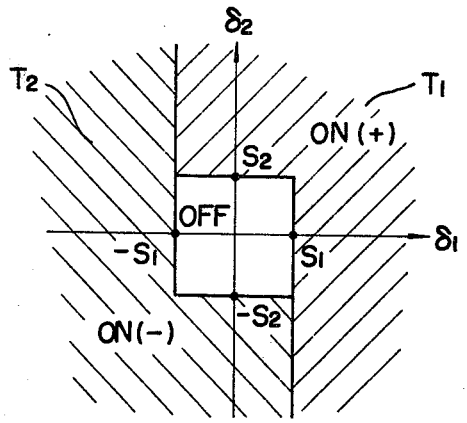
FIG. 6A is a diagrammatic illustration of an output signal of a control deviation computing circuit employed in the control system shown in FIG. 5.
Figure 6B:
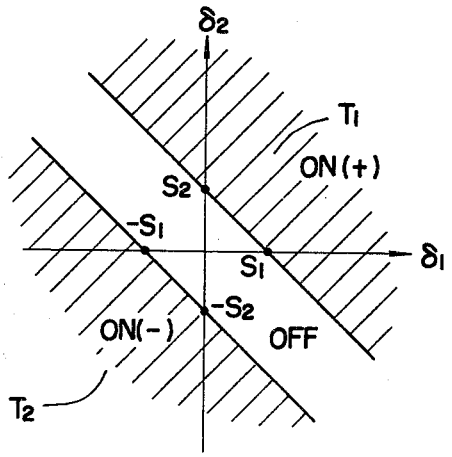
FIG. 6B is a diagrammatic illustration of another form of the output signal of the control deviation computing circuit.

The operation of this control deviation computing circuit 78 will be specifically described with reference to FIGS. 6A and 6B. FIGS. 6A and 6B show the form of the output signal generated by the control deviation computing circuit 78 when the control signal amplifying section 74 is in the form of an on-off control section consisting of a relay, a solenoid-operated valve, etc. In FIG. 6A, the horizontal axis represents the earth pressure deviation $\delta_1$, and the vertical axis represents the earth amount deviation $\delta_2$. It will be seen from FIG. 6A that an OFF signal is generated when the values of $\delta_1$ and $\delta_2$ lie within a certain fixed range satisfying the inequalities $-S_1<\delta_1<S_1$ and $-S_2<\delta_2<S_2$, and an ON(+) signal is generated when the values of $\delta_1$ and $\delta_2$ lie within a range $T_1$ except the aforementioned fixed range, while an ON(−) signal is generated when the values of $\delta_1$ and $\delta_2$ lie within another range $T_2$. The control signal amplifying section 74 is connected to the screw conveyor drive section 64 so that the rotating speed N of the screw conveyor 34 is increased, maintained constant and decreased respectively in response to the appearance of the ON(+) signal, OFF signal and ON(−) signal. More precisely, when now the values of $\delta_1$ and $\delta_2$ lie within the range $T_1$, the earth pressure $P_1$ in the chamber 30 is higher than the reference value, and the ON(+) signal is generated to increase the rotating speed N of the screw conveyor 34 thereby decreasing the earth pressure $P_1$. In this case, even when there is a large response delay in the detected value of earth pressure $P_1$ tending to satisfy the inequality $-S_1<\delta_1<S_1$, the ON(+) signal is generated in response to the increase in the value of $\delta_2$, and acts to decrease the earth pressure $P_1$ thereby causing a delayed increase in the value of $\delta_1$. The earth amount deviation $\delta_2$ is a theoretical value relative to the typical mean value of $\eta_1$, hence, $\eta_{1m}$. Since this earth amount deviation $\delta_2$ does not take into account the factors of disturbance such as the variation in $\eta_1$, it becomes finally necessary to compensate this value by the earth pressure deviation $\delta_1$. FIG. 6B is slightly different from FIG. 6A in the manner of generation of the output signal of the controlled deviation computing circuit 78. However, the basic idea in FIG. 6B is similar to that in FIG. 6A. Thus, in FIG. 6B too, the ON(+) signal is generated in the region $T_1$, and the ON(−) signal is generated in the region $T_2$, while the OFF signal is generated in the region except the above regions.

When the control signal amplifying section 74 is in the form of a proportional control section employing means such as an electrohydraulic servo valve, the output I of the control deviation computing circuit 7 is given by $$I=\alpha\delta_1+\beta\delta_2 \quad (6)$$

$$\alpha, \beta>0$$

Thus, the rotating speed N of the screw conveyor 34 is increased and decreased in proportion to the values of earth pressure deviation $\delta_1$ and earth amount deviation $\delta_2$ so as to finally control the earth pressure $P_1$. In this case, it is desirable to vary the values of $\alpha$ and $\beta$ depending on the nature of soil so as to principally control either $\delta_1$ or $\delta_2$. This is easily achieved by adjusting the gain of the input to the servo amplifier.

A few examples of the output signal from generated by the control deviation computing circuit 78 have been illustrated hereinbefore. The above examples are illustrated merely by way of example. It will be appreciated that this output shown above may easily be varied in its form in accordance with the construction of the control signal amplifying section 74, the nature of soil at the working face, or the design of the shield machine.

In the case of FIG. 1A in which the gap between the face plate 22 and the rotary vanes 24 is relatively narrow, it may become sometimes necessary in the design of the control system to take into account the difference $\Delta P_S$ between the earth pressure at the working face 48 and that in the chamber 30, which difference is produced by the average flow of earth passing through such a gap. In such a case, the difference $\Delta P_S$ may be predicted, and the earth pressure $P_1$ in the chamber 30 may be maintained at a value lower by the predicted difference than the earth pressure at the working face, so as to maintain a proper earth pressure acting upon the working face. Alternatively, the boring speed v may be decreased to reduce dVo/dt so as to maintain $\Delta P_S$ at a practically negligible value. The above consideration has not any direct concern with the present invention, and therefore, further detailed description will not be given herein.

The above description has referred to applications of the present invention to shield machines having screw conveyors as shown in FIGS. 1A, 1B, 2A and 2B. The present invention is also applicable to a shield machine of the kind provided with a conveyed earth control device which can adjust the amount of conveyed earth from zero to a maximum. Further, the earth pressure $P_1$ in the chamber 30 can be maintained within the desired proper range when, in lieu of applying the output signal of the control system to the screw conveyor drive section 64, such signal is applied to the shield jack drive section 62 for automatically controlling the boring or advancing speed of the shield machine body 10. In this case, it is necessary to connect the control system with the shield jack drive section 62 so that the propelling speed of the shield jacks 44 can be decreased with an increase in the earth pressure $P_1$ in the chamber 30.

Yet another embodiment of the present invention will be described with reference to FIGS. 3A, 3B and 7.

Figure 7:
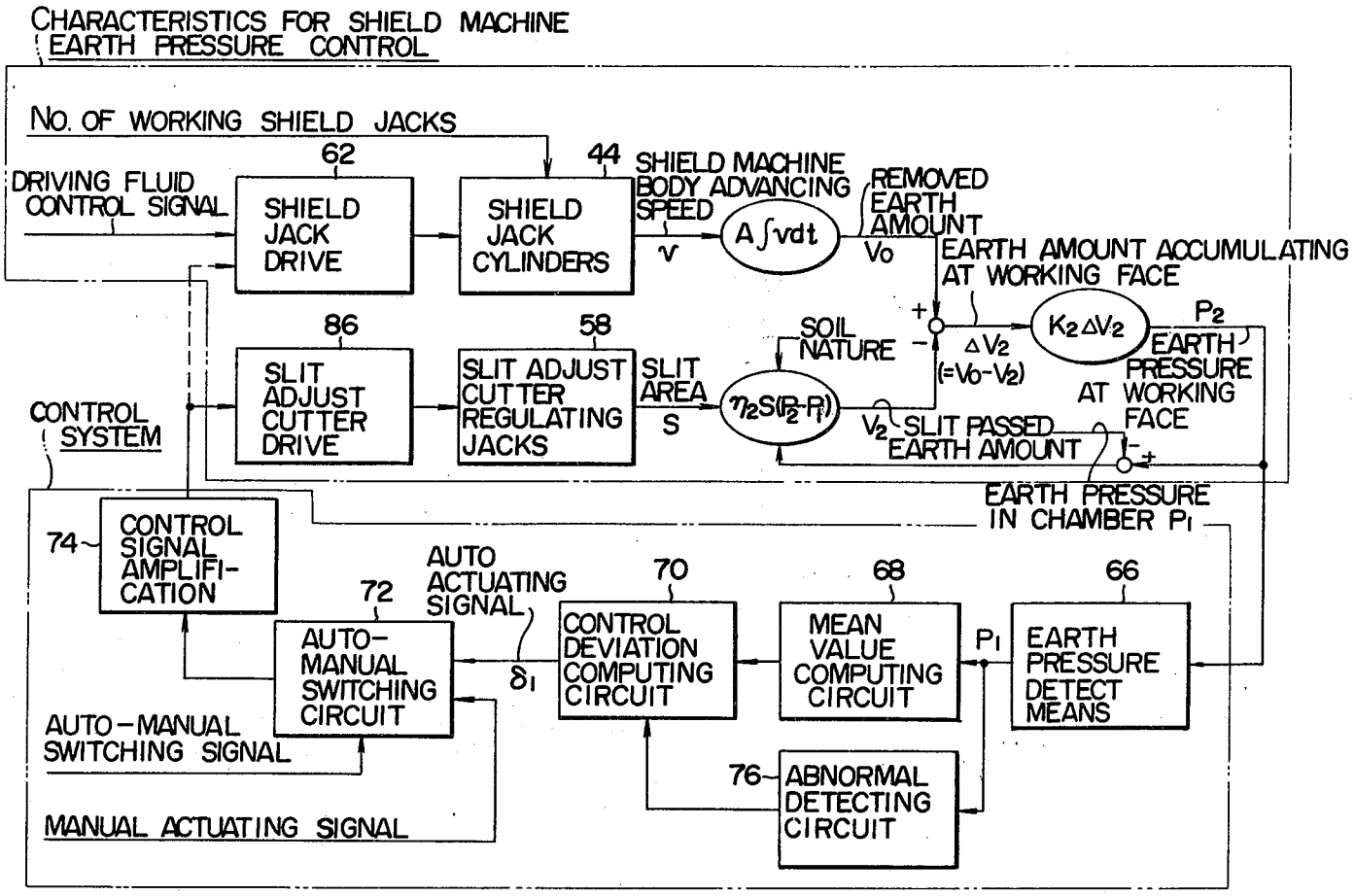
FIG. 7 is a control system diagram according to still another embodiment of the present invention.

FIG. 7 shows various characteristics considered in the present invention for the control of the earth pressure in the shield machine shown in FIGS. 3A and 3B, and shows also the earth pressure control system according to the present invention. Numerical expressions of these characteristics will be discussed at first so that the concept of earth pressure control according to the present invention can be understood.

As in the aforementioned embodiments, a signal for controlling the flow rate of pressure fluid supplied to the shield jacks 44 is similarly applied externally by manual operation by the operator. This control signal determines the output of a shield jack drive section 62 in FIG. 7. This output is used, for example, to control the flow rate of pressure fluid discharged from the hydraulic pump (not shown) for the shield jacks 44 which are connected in parallel to the hydraulic pump. The number n of working shield jacks 44 and the moving speed of the shield jack cylinders are also externally determined by manual operation by the operator. Consequently, the advancing or boring speed v of the shield machine body 10 is determined. Thus, the amount $V_0$ of earth removed by the shield machine is similar to that of the equation (1) and is given by $$V_0=A\int v\,dt \quad (9)$$

where A is the sectional area of the shield machine body 10.

An output corresponding to an input signal appears from a slit-adjusting-cutter-member drive section 86 in FIG. 7. Such an output is applied to the slit-adjusting-cutter-member regulating jacks 58 to determine the total area S of the respective slits 56 between the face plate 22 and the slit adjusting cutter members 54. Thus, the amount $V_2$ of earth passing through the slits 56 and entering the chamber 30 in FIGS. 3A and 3B is given by $$V_2=\eta_2 S\,(P_2-P_1) \quad (10)$$

where $P_2$ is the earth pressure at the working face 48, $P_1$ is the earth pressure in the chamber 30, and $\eta_2$ is a coefficient varying depending on the nature of soil and the dimensions of the slits 56. Therefore, the amount $\Delta V_2$ of earth accumulating at the working face 48 is given by $$\Delta V_2=V_0-V_2 \quad (11)$$

Suppose that the equivalent modulus of volumetric elasticity of earth at the working face 48 is $K_2$ (which is determined by the factors including the nature of soil and the rigidity of the exposed face), then the earth pressure $P_2$ at the working face 48 is given by $$P_2 = K_2 \Delta V_2 \quad (12)$$

The structure of the control system will now be described which controls the earth pressure $P_2$ on the basis of the characteristics obtained as the result of the above analysis. As in the case of the aforementioned embodiments, the actual earth pressure $P_2$ cannot be computed from the formula obtained by the analysis for the aforementioned reason. In the present invention, suitable earth pressure detecting means 66 such as earth pressure meters are mounted on the front side of the hood 40 at a plurality of locations such as those indicated by the symbols d and e and/or on the central portion of the cutter head 12 at a location such as that indicated by the symbol c in FIGS. 3A and 3B for detecting the earth pressures $P_2$ at such locations. These detected values are then averaged so as to average the noise or peak values, or suitable weights are applied to the outputs of the earth pressure meters 66 depending on their locations so as to average the output values. The mean earth pressure $P_{2mean}$ is computed by a mean value computing circuit 68. The output of the mean value computing circuit 68 representing the mean earth pressure $P_{2mean}$ is then applied to a control deviation computing circuit 70 which computes a most suitable control deviation on the basis of a lower limit of earth pressure required for preventing breakdown of the exposed face and an upper limit of earth pressure required for preventing rising of the ground. This deviation signal is applied from the control deviation computing circuit 70 to the slit-adjusting-cutter-member drive section 86 through an automatic-manual switching circuit 72 and a control signal amplifying section 74. The control system is connected to the slit-adjusting-cutter-member drive section 86 so that an increase in the earth pressure $P_2$ at the working face 48 causes a corresponding increase in the total area S of the respective slits 56 between the face plate 22 and the cutter members 54.

An abnormal state detecting circuit 76 is connected between the earth pressure detecting means 66 and the control deviation computing circuit 70. This abnormal state detecting circuit 76 detects the output of the earth pressure meter 66 disposed at the location (such as, the location d in FIGS. 3A and 3B) capable of immediately detecting breakdown of the working face 48, among the plural earth pressure meters 66, and a generates a signal instructing full closure of the slit adjusting cutter members 54 as soon as the detected value attains zero or an allowable minimum. The circuit 76 may also generate an alarm signal indicative of an abnormal condition in the earth pressure meters by detecting inconsistency among the output values of the earth pressure meters 66. As in the aforementioned embodiments, the automatic-manual switching circuit 72 is provided to deal with a soil condition which cannot be covered by the above-mentioned automatic control system alone or to prepare for possible unexpected failure of the automatic control elements. This circuit 72 acts to switch over between the automatic operation and the manual operation in response to a switching signal generated by the operator. It will thus be seen that, by the use of the control system shown in FIG. 7, tunnelling work can be safely carried out while maintaining the earth pressure $P_2$ at the working face 48 at an appropriate value which does not give rise to breakdown of the exposed face and rising of the ground. Further, the shield machine can be operated very easily and with improved reliability since the total area S of the respective slits 56 between the face plate 22 and the cutter members 54 can be automatically controlled.

The above description has been directed to the automatic control of the total area S of the respective slits 56 between the face plate 22 and the cutter members 54. The earth pressure $P_2$ at the working face 48 can also be controlled to be maintained within the predetermined range by applying the output signal of the control system to the shield jack drive section 62 as indicated by the dotted line in FIG. 7 thereby automatically controlling the propelling speed of the shield jacks 44. In such a case, it is necessary to connect the control system with the shield jack drive section 62 so that the propelling speed of the shield jacks 44 can be decreased with an increase in the earth pressure $P_2$ at the working face 48.

Consideration will then be directed to the effects of variations in the factors of disturbance, for example, the coefficient $\eta_2$ and modulus $K_2$ determined depending on the nature of soil, and also variation in the earth pressure $P_1$ in the chamber 30. The control system can be easily designed to have a control capacity which covers variations in $\eta_2$ and $K_2$. It is also possible to adjust $\eta_2$ and $K_2$ within a certain selected range so as to minimize the adverse effects. This may be done by injecting a soil nature adjusting agent such as an aqueous solution of bentonite into the working face 48. The adverse effect due to the variation in the earth pressure $P_1$ in the chamber 30 can also be minimized by suitably controlling the rotating speed N of the screw conveyor 34 shown in FIG. 3B.

Figure 8:
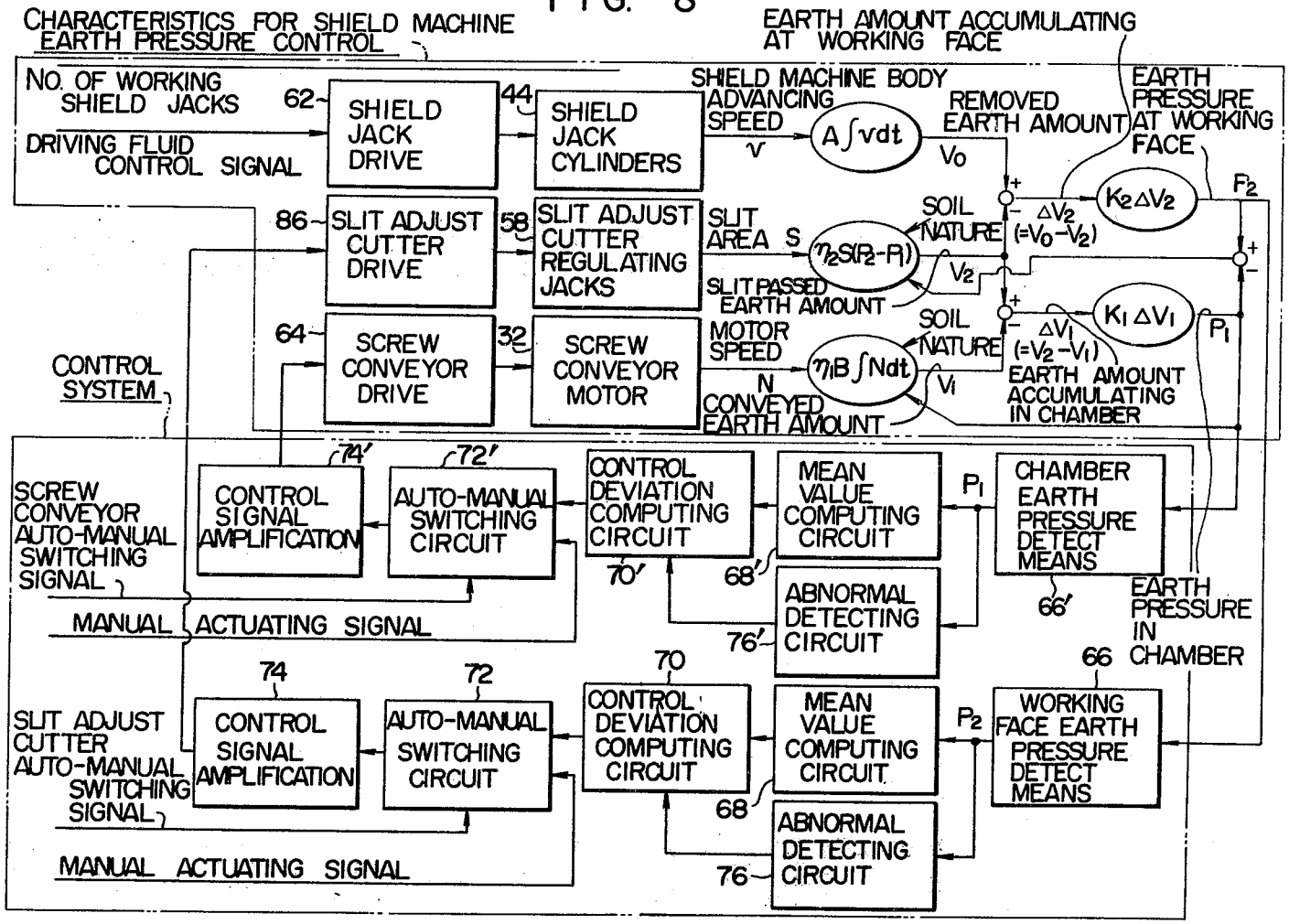
FIG. 8 is a control system diagram according to a further embodiment of the present invention.

FIG. 8 shows a further embodiment of the present invention in which the control of the earth pressure $P_1$ in the chamber 30 is added to the embodiment shown in FIG. 7. In FIG. 8, the same or like reference numerals are used to denote the same or like blocks appearing in FIG. 7.

Numerical expressions of various characteristics in carrying out the earth pressure control in the chamber 30 will be discussed at first. An output corresponding to an input signal appears from a screw conveyor drive section 64 in FIG. 8. Such an output is applied to the hydraulic motor 32 which drives the screw conveyor 34. Consequently, the rotating speed N of the hydraulic motor 32, hence, the screw conveyor 34 is determined. Thus, the amount $V_1$ of earth conveyed by the screw conveyor 34 is entirely similar to that of the equation (2) and is given by $$V_1 = \eta_1 B \int N\,dt \quad (13)$$

where $\eta_1$ is a coefficient varying depending on the nature of soil and the earth pressure $P_1$ in the chamber 30, and B is a constant determined by the dimension of the screw conveyor 34.

The amount $\Delta V_1$ of earth accumulating in the chamber 30 is computed by subtracting the amount $V_1$ of earth conveyed by the screw conveyor 34 from the amount $V_2$ of earth passing through the slits 56 and entering the chamber 30, and is given by $$\Delta V_1 = V_2 - V_1 \quad (14)$$

Therefore, the earth pressure $P_1$ in the chamber 30 is given by $$P_1 = K_1 \Delta V_1 \quad (15)$$

where $K_1$ is the equivalent modulus of volumetric elasticity of mud in the chamber 30. It will thus be seen that the earth pressure $P_1$ in the chamber 30 can be controlled to be maintained within a predetermined range when the rotating speed N of the screw conveyor 34 is increased with an increase in the earth pressure $P_1$.

The structure of the control system will now be described which controls the earth pressure $P_1$ on the basis of the characteristics obtained as the result of the above analysis. Suitable earth pressure detecting means such as earth pressure meters 66' are mounted on the bulkhead 28 at a plurality of locations such as those indicated by the symbols a and b in FIG. 3B for detecting the earth pressures $P_1$ at such portions of the chamber 30. These detected values are then averaged by a mean value computing circuit 68' having a function similar to that described with reference to FIG. 7. The output of the mean value computing circuit 68' is applied to the screw conveyor drive section 64 through a controlled deviation computing circuit 70', an automatic-manual switching circuit 72' and a control signal amplifying section 74' all of which have functions similar to those described with reference to FIG. 7. The amount of earth conveyed by the screw conveyor 34 is increased and decreased with an increase and decrease in the earth pressure $P_1$ in the chamber 30 so that this earth pressure $P_1$ can be controlled to be maintained within the predetermined range.

An abnormal state detecting circuit 76' is similarly connected between the earth pressure detecting means 66' and the control deviation computing circuit 70'. The control deviation computing circuit 70' is designed or set to compute a most suitable control deviation for maintaining the earth pressure at a relatively low constant level which satisfies such conditions that the earth pressure does not impose an appreciable effect on the amount $V_2$ of earth passing through the slits 56 between the face plate 22 and the cutter members 54, earth in muddy condition is supplied smoothly onto the screw conveyor 34, and the internal space of the chamber 30 is always filled with earth. This control deviation computing circuit 70' is essentially the same as the control deviation computing circuit 70 described with reference to FIG. 7 except for its setting.

A soil nature adjusting agent such as an aqueous solution of bentonite may be injected into the chamber 30, or agitating vanes may be provided to agitate earth in muddy condition in the chamber 30 so that the nature of mud in the chamber 30 may become closer to that of ideal soil. These are effective means for further enhancing the notable effects of the present invention.

In boring a tunnel through ground of bad soil conditions, sediment in fluid form may flow into the screw conveyor 34. In such a case, a circuit for automatically closing the slide gate 36 of the screw conveyor 34 may be added to the control system so as to ensure the safety of tunnelling work.

While the present invention has been described in detail with reference to its applications to various forms of rotary cutter type tunnel boring machines, the present invention is also applicable to a tunnel boring machine of the kind operated according to a blind technique. In such a tunnel boring machine, the cutter head 12 and its drive mechanism are eliminated from the rotary cutter type tunnel boring machines shown in FIGS. 1A, 1B, 2A, 2B, 3A and 3B, and a slit is provided in the bulkhead 28. The earth conveying means is disposed behind the slit in the bulkhead 28, and the shield jacks 44 are actuated to propel the shield machine body 10 toward and into the working face. With the advancing movement of the shield machine body 10, the earth is extruded from the working face through the slit in the bulkhead 28 and is conveyed by the conveying means. An earth pressure meter is mounted on a suitable portion of the bulkhead 28 adjacent the working face to detect the earth pressure at the working face. The slit in the bulkhead 28 is made adjustable so that the open area of the slit can be automatically controlled in a manner similar to that described with reference to FIG. 7. Or, the propelling speed of the shield jacks 44 may be similarly automatically controlled to control the earth pressure at the working face.

The present invention described in detail hereinbefore provides the following advantages:

(1) A tunnel can be bored in soft ground while reliably preventing breakdown of the exposed face and rising of the ground.

(2) Tunnelling work can be safely carried out since breakdown of the exposed face can also be mechanically prevented in addition to the prevention by the earth pressure control.

(3) The machine can be reliably and easily operated owing to the automatic control.

(4) The number of ground installations and the area of ground space are far less than those required for the prior art slurry mole shield technique, resulting in great reductions in the equipment and running costs.

(5) The earth pressure in the chamber receiving earth removed from the working face can be maintained within an appropriate range by virtue of the combination of the earth pressure deviation control and the earth amount deviation control. Therefore, the factors of disturbance including the condition of soil can be minimized to ensure reliable earth pressure control.

The present invention has been described with reference to the earth pressure control in the chamber of the shield machine body by detecting the earth pressure with earth pressure meters. It is apparent, however, that the same effect can be achieved when, for example, the stress, displacement or like factor of a constructive member is measured to detect the thrust imparted to the shaft of the cutter head, and the detected value is utilized to control the earth pressure in the chamber of the shield machine body.

What we claim is:

1. In a tunnel boring or shield machine of the earth-pressure control type including a chamber defined between a working face and a bulkhead provided in a machine frame of a shield machine body, means for controlling the amount of earth or muck conveyed from said chamber to the exterior of the machine, and drive means for propelling the shield machine body toward and into the working face, a method for controlling the earth pressure and comprising the steps of:

detecting the earth pressure in said chamber;

comparing the detected earth pressure in said chamber with a reference value thereby generating a signal representing the earth pressure deviation in said chamber; and controlling at least one of said conveyed earth amount control means and said shield machine body driving means in response to said chamber earth pressure deviation signal so as to change at least one of the amount of earth conveyed and the amount of earth removed by advancing said shield machine body thereby maintaining the earth pressure in said chamber within a predetermined range to prevent breakdown of the exposed face and rising of the ground.

2. A method as claimed in claim 1, further comprising the step of responding to an abnormal value of the detected earth pressure in said chamber so that various parts of said shield machine can operate to deal with the abnormal situation.

3. In a tunnel boring or shield machine of the earth-pressure control type including a chamber defined between a working face and a bulkhead provided in a machine frame of a shield machine body, means for controlling the amount of earth or muck conveyed from said chamber to the exterior of the machine, and drive means for propelling said shield machine body toward and into the working face, a method for controlling the earth pressure and comprising the steps of:

detecting the earth pressure in said chamber;

comparing the detected earth pressure in said chamber with a reference value thereby generating a signal representing the earth pressure deviation in said chamber;

detecting the amount of earth or muck removed from the working face;

detecting the amount of earth or muck conveyed by said conveyed earth amount control means;

comparing the amount of removed earth with the amount of conveyed earth thereby generating a signal representing the earth amount deviation provided by the difference therebetween; and controlling at least one of said conveyed earth amount control means and said shield machine body driving means in response to said chamber earth pressure deviation signal and said earth amount deviation signal so as to change at least one of the amount of earth conveyed and the amount of earth removed by advancing said shield machine body thereby maintaining the earth pressure in said chamber within a predetermined range to prevent breakdown of the exposed face and rising of the ground.

4. A method as claimed in claim 3, further comprising the step of responding to an abnormal value of the detected earth pressure in said chamber so that various parts of said shield machine can operate to deal with the abnormal situation.

5. A method as claimed in claim 3, wherein said amount of removed earth or muck is computed on the basis of the detected propelling speed of said shield machine body driving means, and said amount of conveyed earth or muck is computed on the basis of the detected driving speed of said conveyed earth amount control means.

6. In a tunnel boring or shield machine of the earth-pressure control type including a chamber defined between a working face and a bulkhead provided in a machine frame of a shield machine body, means for controlling the amount of earth or muck conveyed from said chamber to the exterior of the machine, and drive means for propelling said shield machine body toward and into the working face, a system for controlling the earth pressure and comprising:

means for detecting the earth pressure in said chamber;

means for comparing the detected earth pressure in said chamber with a reference value thereby generating a signal representing the earth pressure deviation in said chamber; and means responsive to said chamber earth pressure deviation signal for controlling the operation of at least one of said conveyed earth amount control means and said shield machine body driving means so as to change at least one of the amount of earth conveyed and the amount of earth removed by advancing said shield machine body thereby maintaining the earth pressure in said chamber between a lower limit which does not give rise to breakdown of the exposed face and an upper limit which does not give rise to rising of the ground.

7. A system as claimed in claim 6, wherein said means for detecting the earth pressure in said chamber comprises at least one earth pressure meter mounted on said bulkhead.

8. A system as claimed in claim 6, wherein said means for detecting the earth pressure in said chamber comprises at least one earth detector and a mean value computing circuit which averages the output of said earth pressure detector to provide an output signal representing the mean value of the detected earth pressure in said chamber as the value of said detected earth pressure in said chamber.

9. A system as claimed in claim 6, further comprising an abnormal state detecting circuit which detects an abnormal value in the earth pressure in said chamber detected by said earth pressure detecting means and generates an abnormal earth pressure signal so as to control various parts of said shield machine so that these parts can operate to deal with the abnormal situation.

10. In a tunnel boring or shield machine including a chamber defined between a working face and a bulkhead provided in a machine frame of a shield machine body, means for controlling the amount of earth or muck conveyed from said chamber to the exterior of the machine, and drive means for propelling said shield machine body toward and into the working face, a system for controlling the earth pressure and comprising:

means for detecting the earth pressure in said chamber;

means for comparing the detected earth pressure in said chamber with a reference value thereby generating a signal representing the earth pressure deviation in said chamber; and means responsive to said chamber earth pressure deviation signal for controlling the operation of at least one of said conveyed earth amount control means and said shield machine body driving means so as to change at least one of the amount of earth conveyed and the amount of earth removed by advancing said shield machine body thereby maintaining the earth pressure in said chamber between a lower limit which does not give rise to breakdown of the exposed face and an upper limit which does not give rise to rising of the ground and wherein said control means comprises an automatic-manual switching circuit which is connected between said chamber earth pressure deviation signal generating means and at least one of said shield machine body drive means and said conveyed earth amount control means and acts to normally control at least one of said shield machine body drive means and said conveyed earth amount control means in response to said chamber earth pressure deviation signal, but acts to control at least one of said conveyed earth amount control means and said shield machine body driving means in response to an external manual actuating signal when said external manual actuating signal is applied thereto.

11. A system as claimed in claim 6, further comprising means for generating a chamber earth amount deviation signal representing the difference between the amount of earth or muck removed by advancing said shield machine and the amount of earth or muck conveyed by said conveyed earth amount control means, said operation control means carrying out the control for at least one of said conveyed earth amount control means and said shield machine body driving means in response to said chamber earth pressure deviation signal and said earth amount deviation signal.

12. A system as claimed in claim 6, wherein said conveyed earth amount control means comprises a screw conveyor, and said control system further comprises means for measuring the driving speed v of said drive means propelling said shield machine body, means for measuring the rotating speed N of said screw conveyor, and earth amount deviation computing means which operates in response to the application of a signal representing the advancing speed v of said shield machine body and a signal representing the rotating speed N of said screw conveyor to provide an earth amount deviation signal $\delta_2$ representing the difference between the amount of earth or muck removed by advancing said shield machine and the amount of earth or muck conveyed by said screw conveyor and given by the equation $$\delta_2 = Av - \eta_{1m}BN$$

where A is the sectional area of said shield machine body, B is the theoretical amount of earth or muck conveyed per revolution of said screw conveyor, and $\eta_{1m}$ is a typical mean value of the earth conveying efficiency of said screw conveyor varying depending on the nature of soil, said operation control means carrying out the control for at least one of said conveyed earth amount control means and said shield machine body driving means in response to said chamber earth pressure deviation signal $\delta_1$ and said earth amount deviation signal $\delta_2$.

13. In a tunnel boring or shield machine of the earth-pressure control type including a shield machine body, at least one adjustable slit provided in the front end of said shield machine body to permit admission of earth or muck from a working face into said shield machine body, means for controlling the amount of earth or muck conveyed from said shield machine body to the exterior of said shield machine, and drive means for propelling said shield machine body toward and into the working face, a method for controlling the earth pressure and comprising the steps of:

detecting the earth pressure at said working face;

comparing the detected earth pressure at said working face with a reference value thereby generating a signal representing the earth pressure deviation at said working face; and controlling at least one of the opening of said adjustable slit and the propelling speed of said shield machine body driving means in response to said working face earth pressure deviation signal thereby maintaining the earth pressure at said working face within a predetermined range so as to prevent breakdown of the exposed face and rising of the ground.

14. A method as claimed in claim 13, further comprising the step of responding to an abnormal value of the detected earth pressure at said working face so that various parts of said shield machine can operate to deal with the abnormal situation.

15. A method as claimed in claim 13, wherein said shield machine body comprises a bulkhead disposed behind said slit to define a chamber in that portion of said shield machine body, and said method further comprises the steps of:

detecting the earth pressure in said chamber;

comparing the detected earth pressure in said chamber with a reference value thereby generating a signal representing the earth pressure deviation in said chamber; and controlling the amount of earth or muck conveyed by said conveyed earth amount control means in response to said chamber earth pressure deviation signal thereby maintaining the earth pressure at said working face and the earth pressure in said chamber within respective predetermined ranges in conjunction with the control in response to said working face earth pressure deviation signal so as to prevent breakdown of the exposed face and rising of the ground.

16. A method as claimed in claim 15, further comprising the step of responding to an abnormal value of at least one of the detected earth pressure at said working face and the detected earth pressure in said chamber so that various parts of said shield machine can operate to deal with the abnormal situation.

17. In a tunnel boring or shield machine including a shield machine body, at least one adjustable slit provided in the front end of said shield machine body to permit admission of earth or muck from a working face into said shield machine body, means for controlling the amount of earth or muck conveyed from said shield machine body to the exterior of said shield machine, means for adjusting the opening of said slit, and drive means for propelling said shield machine body toward and into the working face, a system for controlling the earth pressure and comprising:

means for detecting the earth pressure at the working face;

means for comparing the detected earth pressure at said working face with a reference value thereby generating a signal representing the earth pressure deviation at said working face; and first control means responsive to said working face earth pressure deviation signal for controlling at least one of said slit opening adjusting means and said shield machine body drive means thereby maintaining the earth pressure at said working face between a lower limit which does not give rise to breakdown of the exposed face and an upper limit which does not give rise to rising of the ground.

18. A system as claimed in claim 17, wherein said shield machine comprises a bulkhead disposed behind said slit to define a chamber in that portion of said shield machine body, and said system further comprises:

means for detecting the earth pressure in said chamber;

means for comparing the detected earth pressure in said chamber with a reference value thereby generating a signal representing the earth pressure deviation in said chamber; and second control means responsive to said chamber earth pressure deviation signal for controlling said conveyed earth amount control means to vary the amount of earth or muck conveyed by said conveyed earth amount control means thereby maintaining the earth pressure in said chamber within a predetermined range, said second control means cooperating with the control by said first control means so as to prevent breakdown of the exposed face and rising of the ground.

19. A system as claimed in claim 17, wherein said means for detecting the earth pressure at said working face comprises at least one earth pressure meter mounted on the front end of said shield machine body.

20. A system as claimed in claim 17, wherein said means for detecting the earth pressure at the working face comprises at least one earth pressure detector and a mean value computing circuit which averages the output of said earth pressure detector to provide an output signal representing the mean value of the detected earth pressure at said working face as said detected earth pressure at said working face.

21. In a tunnel boring or shield machine including a shield machine body, at least one adjustable slit provided in the front end of said shield machine body to permit admission of earth or muck from a working face into said shield machine body, means for controlling the amount of earth or muck conveyed from said shield machine body to the exterior of said shield machine, means for adjusting the opening of said slit, and drive means for propelling said shield machine body toward and into the working face, a system for controlling the earth pressure and comprising:

means for detecting the earth pressure at the working face;

means for comparing the detected earth pressure at said working face with a reference value thereby generating a signal representing the earth pressure deviation at said working face; and first control means responsive to said working face earth pressure deviation signal for controlling at least one of said slit opening adjusting means and said shield machine body drive means thereby maintaining the earth pressure at said working face between a lower limit which does not give rise to breakdown of the exposed face and an upper limit which does not give rise to rising of the ground and further comprising an abnormal state detecting circuit which detects an abnormal value in the earth pressure in said working face detected by said earth pressure means and generates an abnormal earth pressure signal so as to control various parts of said shield machine so that these parts can operate to deal with the abnormal situation.

22. A system as claimed in claim 18, wherein said means for detecting the earth pressure at the working face comprises at least one first earth pressure meter mounted on the front end of said shield machine body, and said means for detecting the earth pressure in said chamber comprises at least one second earth pressure meter mounted on said bulkhead.

23. A system as claimed in claim 18, wherein said means for detecting the earth pressure at the working face comprises at least one first earth pressure detector and a first mean value computing circuit which averages the output of said first earth pressure detector to provide an output signal representing the mean value of the detected earth pressure at said working face as said detected earth pressure at said working face, and said means for detecting the earth pressure in said chamber comprises at least one second earth pressure detector and a second mean value computing circuit which averages the output of said second earth pressure detector and generates an output signal representing the mean value of the detected earth pressure in said chamber as said detected earth pressure in said chamber.

24. In a tunnel boring or shield machine including a shield machine body, at least one adjustable slit provided in the front end of said shield machine body to permit admission of earth or muck from a working face into said shield machine body, means for controlling the amount of earth or muck conveyed from said shield machine body to the exterior of said shield machine, means for adjusting the opening of said slit, and drive means for propelling said shield machine body toward and into the working face, a system for controlling the earth pressure and comprising:

means for detecting the earth pressure at the working face;

means for comparing the detected earth pressure at said working face with a reference value thereby generating a signal representing the earth pressure deviation at said working face; and first control means responsive to said working face earth pressure deviation signal for controlling at least one of said slit opening adjusting means and said shield machine body drive means whereby maintaining the earth pressure at said working face between a lower limit which does not give rise to breakdown of the exposed face and an upper limit which does not give rise to rising of the ground, and wherein said shield machine comprises a bulkhead disposed behind said slit to define a chamber in that portion of said shield machine body, and said system further comprises:

means for detecting the earth pressure in said chamber;

means for comparing the detected earth pressure in said chamber with a reference value thereby generating a signal representing the earth pressure deviation in said chamber; and second control means responsive to said chamber earth pressure deviation signal for controlling said conveyed earth amount control means to vary the amount of earth or muck conveyed by said conveyed earth amount control means thereby maintaining the earth pressure in said chamber within a predetermined range, said second control means cooperating with the control by said first control means so as to prevent breakdown of the exposed face and rising of the ground, and further comprising an abnormal state detecting circuit which detects an abnormal value in the earth pressure in at least one of said chamber and working face detected by said first and second earth pressure detectors and generates an abnormal earth pressure signal so as to control various parts of said shield machine so that these parts can operate to deal with the abnormal situation.

25. In a tunnel boring or shield machine including a shield machine body, at least one adjustable slit provided in the front end of said shield machine body tc permit admission of earth or muck from a working face into said shield machine body, means for controlling the amount of earth or muck conveyed from said shield machine body to the exterior of said shield machine, means for adjusting the opening of said slit, and drive means for propelling said shield machine body toward and into the working face, a system for controlling the earth pressure and comprising:

means for detecting the earth pressure at the working face;

means for comparing the detected earth pressure at said working face with a reference value thereby generating a signal representing the earth pressure deviation at said working face; and first control means responsive to said working face earth pressure deviation signal for controlling at least one of said slit opening adjusting means and said shield machine body drive means thereby maintaining the earth pressure at said working face between a lower limit which does not give rise to breakdown of the exposed face and an upper limit which does not give rise to rising of the ground and wherein said first control means comprises an automatic-manual switching circuit which is connected between said working face earth pressure deviation signal generating means and at least one of said shield machine body drive means and said slit opening adjusting means and acts to normally control at least one of said shield machine body drive means and said slit opening adjusting means in response to said working face earth pressure deviation signal, but acts to control at least one of said shield machine body drive means and said slit opening adjusting means in response to an external manual actuating signal when said external manual actuating signal is applied thereto.

26. In a tunnel boring or shield machine including a shield machine body, at least one adjustable slit provided in the front end of said shield machine body to permit admission of earth or muck from a working face into said shield machine body, means for controlling the amount of earth or muck conveyed from said shield machine body to the exterior of said shield machine, means for adjusting the opening of said slit, and drive means for propelling said shield machine body toward and into the working face, a system for controlling the earth pressure and comprising:

means for detecting the earth pressure at the working face;

means for comparing the detected earth pressure at said working face with a reference value thereby generating a signal representing the earth pressure deviation at said working face; and first control means responsive to said working face earth pressure deviation signal for controlling at least one of said slit opening adjusting means and said shield machine body drive means thereby maintaining the earth pressure at said working face between a lower limit which does not give rise to breakdown of the exposed face and an upper limit which does not give rise to rising of the ground, wherein said shield machine comprises a bulkhead disposed behind said slit to define a chamber in that portion of said shield machine body, and said system further comprises:

means for detecting the earth pressure in said chamber;

means for comparing the detected earth pressure in said chamber with a reference value thereby generating a signal representing the earth pressure deviation in said chamber and second control means responsive to said chamber earth pressure deviation signal for controlling said conveyed earth amount control means to vary the amount of earth or muck conveyed by said conveyed earth amount control means thereby maintaining the earth pressure in said chamber within a predetermined range, said second control means cooperating with the control by said first control means so as to prevent breakdown of the exposed face and rising of the ground and wherein said first control means comprises a first automatic-manual switching circuit which is connected between said working face earth pressure deviation signal generating means and at least one of said shield machine body drive means and said slit opening adjusting means and acts normally to control at least one of said shield machine body drive means and said slit opening adjusting means in response to said working face earth pressure deviation signal, but acts to control at least one of said shield machine drive means and said slit opening adjusting means in response to a first external manual actuating signal when said first external manual actuating signal is applied thereto, and said second control means comprises a second automatic-manual switching circuit which is connected between said chamber earth pressure deviation signal generating means and said conveyed earth amount control means and acts normally to control said conveyed earth amount control means in response to said chamber earth pressure deviation signal, but acts to control said conveyed earth amount control means in response to a second external manual actuating signal when said second external manual actuating signal is applied thereto.

* * * * *